US005711329A

United States Patent [19]

Soon

[11] Patent Number: 5,711,329

[45] Date of Patent: Jan. 27, 1998

[54] SELF-CLEANING KNOB WATER FAUCET

[76] Inventor: Min Tet Soon, P.O. Box 10341, 88803 Kota Kinabalu, Sabah, Malaysia

[21] Appl. No.: 654,214

[22] Filed: May 28, 1996

[51] Int. Cl.[6] ..... B08B 3/02

[52] U.S. Cl. ..... 134/115 R; 137/238; 239/25; 239/113

[58] Field of Search ..... 134/104.1, 115 R; 4/675; 137/238, 801; 239/25, 26, 27, 113

[56] References Cited

U.S. PATENT DOCUMENTS

| | | | |
|---|---|---|---|
| D. 331,277 | 11/1992 | Murphy | D23/263 |
| 899,330 | 9/1908 | Schierloh | 137/801 X |
| 1,078,939 | 11/1913 | Miller et al. | 239/25 X |
| 1,091,135 | 3/1914 | Hetherington | 239/25 |
| 1,392,456 | 10/1921 | Spatter et al. | 239/25 |
| 1,555,618 | 9/1925 | Aselin | 239/25 |
| 3,913,839 | 10/1975 | Wilson | 239/267 |
| 4,344,452 | 8/1982 | Sato | 137/238 |
| 5,170,518 | 12/1992 | Warriner | 4/620 |
| 5,199,118 | 4/1993 | Cole et al. | 4/619 |
| 5,217,035 | 6/1993 | Van Marcke | 137/1 |
| 5,265,628 | 11/1993 | Sage et al. | 134/58 R |

*Primary Examiner*—Philip R. Coe

*Attorney, Agent, or Firm*—Richard L. Miller, P.E. Registered Patent Agent

[57] ABSTRACT

A self-cleaning knob water faucet that includes a hollow water faucet housing, a water valve assembly, a knob, and water showering apparatus. The hollow water faucet body has an interior space and a spout from which water can exit. The water valve assembly is disposed in the hollow water faucet housing and has a distal end that extends outwardly therefrom. The water valve further has a closed position in which water does not exit the spout of the hollow water faucet body and an open position in which water exits the spout of the hollow water faucet body. The knob is disposed on the distal end of the water valve and is rotatable by a hand of user for moving the water valve assembly through the closed position of the water valve assembly and the open position of the water valve assembly. And, the water showering apparatus showers water on the knob when the water valve assembly is in the open position of the water valve assembly, so that any contamination deposited on the knob when the knob is rotated by the hand of the user is removed.

17 Claims, 2 Drawing Sheets

SELF-CLEANING KNOB WATER FAUCET

BACKGROUND OF THE INVENTION

The present invention relates to a self-cleaning knob water faucet. More particularly, the present invention relates to a self-cleaning knob water faucet that includes dispensing means for automatically dispensing water onto the water faucet knob when the water faucet is in the open position.

Usually, the knobs of a water faucet can be become contaminated by detergents, toners, bacteria and the like.

When a person's hands have become dirty and they wish to have them washed clean, the knobs of the water faucets that are manually turned on by the person's dirty hands become dirty themselves. After the person has cleaned his dirty hands and proceeds to manually turn off the water faucets, the person's clean hands become dirty again.

Numerous innovations for human washing devices have been provided in the prior art that will be described. However, even though these innovations may be suitable for the specific individual purposes to which they address, they differ from the present invention in that they do not teach a self-cleaning knob water faucet that includes dispensing means for automatically dispensing water onto the water faucet knob when the water faucet is in the open position.

FOR EXAMPLE, U.S. Pat. No. Des. 331,277 to Murphy teaches a Y-shaped pipe for feeding water simultaneously to a pair of tandem shower heads.

ANOTHER EXAMPLE, U.S. Pat. No. 3,913,839 to Wilson teaches an attachment device for converting a single shower head personal shower installation to dual, opposed shower head installations to provide for showing at each side of the shower enclosure or recess in which the device is installed.

STILL ANOTHER EXAMPLE, U.S. Pat. No. 5,199,118 to Cole et al. teaches a hand sanitizing wash station that includes a sink, a soap dispenser located above the sink for supplying soap, a water dispensing faucet located above the sink operated by a solenoid valve, and a hot-air dryer located above the sink for supplying hot air.

YET ANOTHER EXAMPLE, U.S. Pat. No. 5,217,035 to Van Marcke teaches a washroom control system that automatically controls water valves and soap valves by infrared sensing of a user's hands, tests a battery to determine whether enough energy is stored to reliably close a valve, and generates an alarm if the battery needs replacing.

FINALLY, STILL YET ANOTHER EXAMPLE, U.S. Pat. No. 5,265,628 to Sage et al. teaches a hand washing system that includes nozzles rotating in a cylinder that through a program provides purge, wash, dwell, rinse, and self-clean cycles.

It is apparent that numerous innovations for human washing devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a self-cleaning knob water faucet that avoids the disadvantages of the prior art.

ANOTHER OBJECT of the present invention is to provide a self-cleaning knob water faucet that is simple and inexpensive to manufacture.

STILL ANOTHER OBJECT of the present invention is to provide a self-cleaning knob water faucet that is simple to use.

YET ANOTHER OBJECT of the present invention is to provide a self-cleaning knob water faucet that will eliminate contamination of the knob of a water faucet by detergents, toners, bacteria and the like.

STILL YET ANOTHER OBJECT of the present invention is to provide a self-cleaning knob water faucet that will automatically clean the knob of a water faucet, each time the water faucet is turned on, after it has become contaminated YET STILL ANOTHER OBJECT of the present invention is to provide a self-cleaning knob water faucet that can be used in homes, offices, public toilets, hospitals and the like.

STILL YET ANOTHER OBJECT of the present invention is to provide a self-cleaning knob water faucet that will provide a more hygienic environment.

YET STILL ANOTHER OBJECT of the present invention is to provide a self-cleaning knob water faucet that will reduce the diseases spread through skin contact, especially through public toilets.

STILL YET ANOTHER OBJECT of the present invention is to provide a self-cleaning knob water faucet that will eliminate soap bubble stains on the knob of a water faucet.

YET STILL ANOTHER OBJECT of the present invention is to provide a self-cleaning knob water faucet for installation on the column of an overhead-type spout, so that water will flow from a short secondary spout disposed on the column onto, and self-clean, the knob until the self-cleaning knob water faucet is turned off at which point the water in the overhead-type spout will flow backwards and seek its own level.

STILL YET ANOTHER OBJECT of the present invention is to provide a self-cleaning knob water faucet that replaces a conventional-type water faucet, so that water will flow from the top of the knob onto, and self-clean, the knob until the self-cleaning knob water faucet is turned off.

BRIEFLY STATED, YET ANOTHER OBJECT of the present invention is to provide a self-cleaning knob water faucet that includes a hollow water faucet housing, a water valve assembly, a knob, and water showering apparatus.

STILL YET ANOTHER OBJECT of the present invention is to provide a self-cleaning knob water faucet wherein the hollow water faucet body has an interior space and a spout from which water can exit.

BRIEFLY STATED, YET ANOTHER OBJECT of the present invention is to provide a self-cleaning knob water faucet wherein the water valve assembly is disposed in the hollow water faucet housing and has a distal end that extends outwardly therefrom.

STILL YET ANOTHER OBJECT of the present invention is to provide a self-cleaning knob water faucet wherein the water valve further has a closed position in which water does not exit the spout of the hollow water faucet body and an open position in which water exits the spout of the hollow water faucet body.

YET ANOTHER OBJECT of the present invention is to provide a self-cleaning knob water faucet wherein the knob is disposed on the distal end of the water valve and is rotatable by a hand of user for moving the water valve assembly through the closed position of the water valve assembly and the open position of the water valve assembly.

STILL YET ANOTHER OBJECT of the present invention is to provide a self-cleaning knob water faucet wherein the water showering apparatus showers water on the knob when the water valve assembly is in the open position of the water valve assembly, so that any contamination deposited on the knob when the knob is rotated by the hand of the user is removed.

YET ANOTHER OBJECT of the present invention is to provide a self-cleaning knob water faucet wherein the water valve assembly includes the water showering apparatus.

STILL YET ANOTHER OBJECT of the present invention is to provide a self-cleaning knob water faucet wherein the water valve assembly further includes a hollow, longitudinally-oriented, externally-threaded, cylindrically-shaped, and slender valve stem that has a longitudinal axis, a proximal end disposed in the hollow water faucet body, a distal end disposed outside the hollow water faucet body, and an internally-disposed and longitudinally-oriented channel that extends from the proximal end of the hollow, longitudinally-oriented, externally-threaded, cylindrically-shaped, and slender valve stem of the water valve assembly to the distal end of the hollow, longitudinally-oriented, externally-threaded, cylindrically-shaped, and slender valve stem of the water valve assembly.

YET ANOTHER OBJECT of the present invention is to provide a self-cleaning knob water faucet wherein the proximal end of the hollow, longitudinally-oriented, externally-threaded, cylindrically-shaped, and slender valve stem of the water valve assembly has a laterally-oriented and internally-threaded metering throughbore that passes completely through the proximal end of the hollow, longitudinally-oriented, externally-threaded, cylindrically-shaped, and slender valve stem of the water valve assembly.

STILL YET ANOTHER OBJECT of the present invention is to provide a self-cleaning knob water faucet wherein the laterally-oriented and internally-threaded metering throughbore of the proximal end of the hollow, longitudinally-oriented, externally-threaded, cylindrically-shaped, and slender valve stem of the water valve assembly opens into both the internally-disposed and longitudinally-oriented channel of the hollow, longitudinally-oriented, externally-threaded, cylindrically-shaped, and slender valve stem of the water valve assembly and the interior space of the hollow faucet body, so that there is an amount of direct fluid communication between the internally-disposed and longitudinally-oriented channel of the hollow, longitudinally-oriented, externally-threaded, cylindrically-shaped, and slender valve stem of the water valve assembly and the interior space of the hollow faucet body.

YET ANOTHER OBJECT of the present invention is to provide a self-cleaning knob water faucet wherein the proximal end of the hollow, longitudinally-oriented, externally-threaded, cylindrically-shaped, and slender valve stem of the water valve assembly further has a laterally-oriented and externally-threaded metering screw that threadably engages the laterally-oriented and internally-threaded metering throughbore of the proximal end of the hollow, longitudinally-oriented, externally-threaded, cylindrically-shaped, and slender valve stem of the water valve assembly, so that the amount of direct fluid communication between the internally-disposed and longitudinally-oriented channel of the hollow, longitudinally-oriented, externally-threaded, cylindrically-shaped, and slender valve stem of the water valve assembly and the interior space of the hollow faucet body can be metered.

STILL YET ANOTHER OBJECT of the present invention is to provide a self-cleaning knob water faucet wherein the laterally-oriented and externally-threaded metering screw of the proximal end of the hollow, longitudinally-oriented, externally-threaded, cylindrically-shaped, and slender valve stem of the water valve assembly is plastic.

YET ANOTHER OBJECT of the present invention is to provide a self-cleaning knob water faucet that further includes an allen key that is removably engagable with the laterally-oriented and externally-threaded metering screw of the proximal end of the hollow, longitudinally-oriented, externally-threaded, cylindrically-shaped, and slender valve stem of the water valve assembly, so that the laterally-oriented and externally-threaded metering screw of the proximal end of the hollow, longitudinally-oriented, externally-threaded, cylindrically-shaped, and slender valve stem of the water valve assembly can be readily moved relative to the laterally-oriented and internally-threaded metering throughbore of the proximal end of the hollow, longitudinally-oriented, externally-threaded, cylindrically-shaped, and slender valve stem of the water valve assembly.

STILL YET ANOTHER OBJECT of the present invention is to provide a self-cleaning knob water faucet wherein the knob has an upper surface with a longitudinally-oriented, centrally-disposed, and cylindrically-shaped upper chamber that has a longitudinal axis and a diameter.

YET ANOTHER OBJECT of the present invention is to provide a self-cleaning knob water faucet wherein the longitudinally-oriented, centrally-disposed, and cylindrically-shaped upper chamber of the upper surface of the knob opens into the upper surface of the knob.

STILL YET ANOTHER OBJECT of the present invention is to provide a self-cleaning knob water faucet wherein the longitudinal axis of the longitudinally-oriented, centrally-disposed, and cylindrically-shaped upper chamber of the upper surface of the knob is collinear with the longitudinal axis of the hollow, longitudinally-oriented, externally-threaded, cylindrically-shaped, and slender valve stem of the water valve assembly.

YET ANOTHER OBJECT of the present invention is to provide a self-cleaning knob water faucet wherein the knob further has a lower surface with a longitudinally-oriented and centrally-disposed lower chamber that has a longitudinal axis and a diameter.

STILL YET ANOTHER OBJECT of the present invention is to provide a self-cleaning knob water faucet wherein the longitudinally-oriented and centrally-disposed lower chamber of the lower surface of the knob opens into the lower surface of the knob.

YET ANOTHER OBJECT of the present invention is to provide a self-cleaning knob water faucet wherein the longitudinal axis of the longitudinally-oriented and centrally-disposed lower chamber of the lower surface of the knob is collinear with the longitudinal axis of the hollow, longitudinally-oriented, externally-threaded, cylindrically-shaped, and slender valve stem of the water valve assembly.

STILL YET ANOTHER OBJECT of the present invention is to provide a self-cleaning knob water faucet wherein the longitudinally-oriented and centrally-disposed lower chamber of the lower surface of the knob securely receives the distal end of the hollow, longitudinally-oriented, externally-threaded, cylindrically-shaped, and slender valve stem of the water valve assembly, so that rotation of the knob relative to the water valve assembly is eliminated.

YET ANOTHER OBJECT of the present invention is to provide a self-cleaning knob water faucet wherein the knob further has a longitudinally-oriented, centrally-disposed, and cylindrically-shaped intermediate chamber that has a longitudinal axis and a diameter.

STILL YET ANOTHER OBJECT of the present invention is to provide a self-cleaning knob water faucet wherein the longitudinally-oriented, centrally-disposed, and cylindrically-shaped intermediate chamber of the knob opens into both the longitudinally-oriented, centrally-disposed, and cylindrically-shaped upper chamber of the upper surface of the knob and the longitudinally-oriented and centrally-disposed lower chamber of the lower surface of the knob.

YET ANOTHER OBJECT of the present invention is to provide a self-cleaning knob water faucet wherein the longitudinal axis of the longitudinally-oriented, centrally-disposed, and cylindrically-shaped intermediate chamber of the knob is collinear with the longitudinal axis of the hollow, longitudinally-oriented, externally-threaded, cylindrically-shaped, and slender valve stem of the water valve assembly.

STILL YET ANOTHER OBJECT of the present invention is to provide a self-cleaning knob water faucet wherein the diameter of the longitudinally-oriented, centrally-disposed, and cylindrically-shaped intermediate chamber of the knob is less than the diameter of each of the longitudinally-oriented, centrally-disposed, and cylindrically-shaped upper chamber of the upper surface of the knob and the longitudinally-oriented and centrally-disposed lower chamber of the lower surface of the knob, so that the distal end of the hollow, longitudinally-oriented, externally-threaded, cylindrically-shaped, and slender valve stem of the water valve assembly will not pass through the knob.

YET ANOTHER OBJECT of the present invention is to provide a self-cleaning knob water faucet that further includes a hollow knob mounting bolt for readily removably securing the knob to the distal end of the hollow, longitudinally-oriented, externally-threaded, cylindrically-shaped, and slender valve stem of the water valve assembly.

STILL YET ANOTHER OBJECT of the present invention is to provide a self-cleaning knob water faucet wherein the hollow knob mounting bolt has a hollow, open-ended, and octagon-shaped upper portion with a diameter and an interior space, so that the hollow knob mounting bolt can be readily turned by a conventional tool.

YET ANOTHER OBJECT of the present invention is to provide a self-cleaning knob water faucet wherein the diameter of the hollow, open-ended, and octagon-shaped upper portion of the hollow knob mounting bolt is greater than the diameter of the longitudinally-oriented, centrally-disposed, and cylindrically-shaped intermediate chamber of the knob, so that the hollow knob mounting bolt will not pass therethrough.

STILL YET ANOTHER OBJECT of the present invention is to provide a self-cleaning knob water faucet wherein the hollow, open-ended, and octagon-shaped upper portion of the hollow knob mounting bolt has a plurality of radially-disposed channels that open into both the interior space of the hollow, open-ended, and octagon-shaped upper portion of the hollow knob mounting bolt and the longitudinally-oriented, centrally-disposed, and cylindrically-shaped upper chamber of the upper surface of the knob.

YET ANOTHER OBJECT of the present invention is to provide a self-cleaning knob water faucet wherein the hollow knob mounting bolt further has a hollow, open-ended, externally-threaded, and cylindrically-shaped lower portion with an interior space.

STILL YET ANOTHER OBJECT of the present invention is to provide a self-cleaning knob water faucet wherein the hollow, open-ended, externally-threaded, and cylindrically-shaped lower portion of the hollow mounting bolt is integral with, and extends downwardly from, the hollow, open-ended, and octagon-shaped upper portion of the knob mounting bolt.

YET ANOTHER OBJECT of the present invention is to provide a self-cleaning knob water faucet wherein the interior space of the hollow, open-ended, externally-threaded, and cylindrically-shaped lower portion of the hollow knob mounting bolt opens into both the interior space of the hollow, open-ended, and octagon-shaped upper portion of the hollow knob mounting bolt and the internally-disposed and longitudinally-oriented channel of the hollow, longitudinally-oriented, externally-threaded, cylindrically-shaped, and slender valve stem of the water valve assembly.

STILL YET ANOTHER OBJECT of the present invention is to provide a self-cleaning knob water faucet wherein the hollow, open-ended, externally-threaded, and cylindrically-shaped lower portion of the hollow mounting bolt passes through the longitudinally-oriented, centrally-disposed, and cylindrically-shaped intermediate chamber of the knob and threadably engages the hollow and internally-threaded distal end of the hollow, longitudinally-oriented, externally-threaded, cylindrically-shaped, and slender valve stem of the water valve assembly, so that the knob can be readily removably secured to the hollow, longitudinally-oriented, externally-threaded, cylindrically-shaped, and slender valve stem of the water valve assembly.

YET ANOTHER OBJECT of the present invention is to provide a self-cleaning knob water faucet that further includes a convexo-concave-shaped decorative button that is removably snapingly mounted in the longitudinally-oriented, centrally-disposed, and cylindrically-shaped upper chamber of the upper surface of the knob and has a plurality of radially-disposed channels.

STILL YET ANOTHER OBJECT of the present invention is to provide a self-cleaning knob water faucet wherein the plurality of radially-disposed channels of the convexo-concave-shaped decorative button open into both the ambient and the longitudinally-oriented, centrally-disposed, and cylindrically-shaped upper chamber of the upper surface the knob, so that water passing through the plurality of radially-disposed channels of the convexo-concave-shaped decorative button shower and clean the knob.

YET ANOTHER OBJECT of the present invention is to provide a self-cleaning knob water faucet wherein the water showing apparatus is disposed at the hollow water faucet body above the water valve assembly.

STILL YET ANOTHER OBJECT of the present invention is to provide a self-cleaning knob water faucet wherein the water showering apparatus includes a hollow, open-ended, and cylindrically-shaped sprinkler housing that has an interior space that opens into both the interior space of the hollow water faucet body and the ambient.

YET ANOTHER OBJECT of the present invention is to provide a self-cleaning knob water faucet wherein the hollow, open-ended, and cylindrically-shaped sprinkler housing of the water showering means is oriented outwardly and downwardly towards the knob.

STILL YET ANOTHER OBJECT of the present invention is to provide a self-cleaning knob water faucet wherein the water showering apparatus further includes a hollow, open front, substantially closed top and bottom, and internally-disposed enclosure that has a substantially closed top, a substantially closed bottom, an open front, and is disposed internally to the hollow water faucet body.

YET ANOTHER OBJECT of the present invention is to provide a self-cleaning knob water faucet wherein the hollow, open front, substantially closed top and bottom, and internally-disposed enclosure of the water showering apparatus opens into the hollow, open-ended, and cylindrically-shaped sprinkler housing of the showering apparatus through the open front of the hollow, open front, substantially closed top and bottom, and internally-disposed enclosure of the water showering apparatus.

STILL YET ANOTHER OBJECT of the present invention is to provide a self-cleaning knob water faucet wherein the hollow, open front, substantially closed top and bottom, and internally-disposed enclosure of the water showering apparatus further has a longitudinally-oriented and internally-threaded throughbore that passes in longitudinal alignment completely through both the substantially closed top of the hollow, open front, substantially closed top and bottom, and internally-disposed enclosure of the water showering apparatus and the substantially closed bottom of the hollow, open front, substantially closed top and bottom, and internally-disposed enclosure of the water showering apparatus.

FINALLY, YET ANOTHER OBJECT of the present invention is to provide a self-cleaning knob water faucet wherein the water showering apparatus further includes a longitudinally-oriented and externally-threaded screw that threadably engages the longitudinally-oriented and internally-threaded throughbore of the hollow, open front, substantially closed top and bottom, and internally-disposed enclosure of the water showering apparatus.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The Figures on the drawing are briefly described as follows.

LIST OF REFERENCE NUMERALS UTILIZED IN THE DRAWING

First Specific Embodiment

Figures 1, 5:
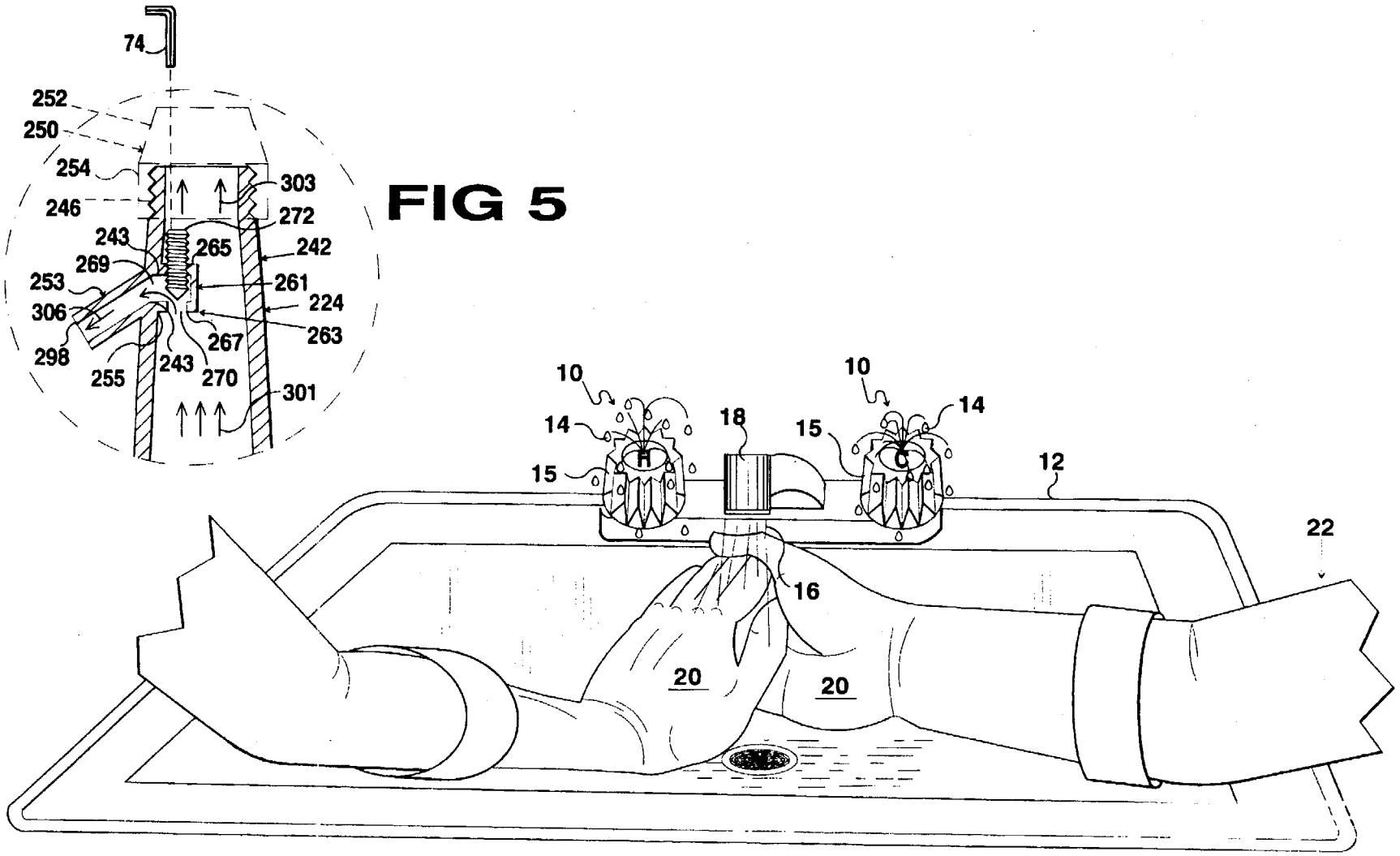
FIG. 1 is a diagrammatic front perspective view of a general embodiment of the present invention replacing a conventional-type water faucet and being used to wash a pair of hands in a sink.
FIG. 5 is an enlarged cross sectional view, with parts broken away, of the area enclosed by dotted circle identified by arrow 5 in FIG. 4.

10 self-cleaning knob water faucet of the present invention
12 sink
14 showering water
15 knob
16 spout water
18 spout
20 pair of user hands
22 user
24 hollow faucet body
26 hollow, open-ended, externally-threaded, and cylindrically-shaped faucet body lower portion
28 faucet body lower portion diameter and a faucet body lower portion open upper end
30 hollow, open-ended, and cylindrically-shaped faucet body intermediate portion
32 faucet body intermediate portion diameter, a faucet body intermediate portion open lower end
34 faucet body intermediate portion open upper end
36 faucet body intermediate portion lateral throughbore
38 internally-disposed faucet body valve seat
40 hollow faucet body arm
42 hollow, open-ended, internally-threaded, and frustrum-shaped faucet body upper portion
44 faucet body upper portion open lower end
46 faucet body upper portion open upper end
48 valve assembly
50 hollow and open-ended packing lock fitting
52 hollow, open-ended, and octagon-shaped packing lock fitting upper portion
54 hollow, open-ended, internally and externally-threaded, and cylindrically-shaped packing lock fitting lower portion
56 hollow, longitudinally-oriented, externally-threaded, cylindrically-shaped, and slender valve assembly stem
58 hollow and internally-threaded valve assembly stem upper end
60 valve assembly stem lower end sub-assembly
62 longitudinally-oriented, centrally-disposed, and internally-threaded valve assembly stem lower end sub-assembly bore
64 laterally-disposed and cup-shaped valve assembly stem lower end sub-assembly washer receptacle
66 valve assembly stem lower end sub-assembly washer
68 valve assembly stem lower end sub-assembly washer threaded screw
70 a laterally-oriented and internally-threaded valve assembly stem lower end sub-assembly metering throughbore
72 laterally-oriented and externally-threaded valve assembly stem lower end sub-assembly metering allen screw
74 standard allen key
76 knob upper surface
78 longitudinally-oriented, centrally-disposed, and cylindrically-shaped knob upper surface chamber
80 knob lower surface
82 longitudinally-oriented, centrally-disposed, and cylindrically-shaped knob lower surface chamber
84 longitudinally-oriented, centrally-disposed, and cylindrically-shaped knob upper intermediate chamber
86 longitudinally-oriented and centrally-disposed knob lower intermediate chamber
88 knob mounting bolt
90 hollow, open-ended, and octagon-shaped knob mounting bolt upper portion
92 plurality of radially-disposed knob mounting bolt upper portion channels
94 hollow, open-ended, externally-threaded, and cylindrically-shaped knob mounting bolt lower portion
96 convexo-concave-shaped decorative button
98 plurality of radially-disposed button sprinkler channels
100 water source arrows
102 arm water arrows
104 spout water arrows
106 valve assembly water arrow
108 bolt water arrow
110 knob water arrows Second Specific Embodiment

210 self-cleaning knob water faucet of the present invention
224 hollow faucet body
226 hollow, open-ended, externally-threaded, and cylindrically-shaped faucet body lower portion
228 faucet body lower portion diameter and a faucet body lower portion open upper end
230 hollow, open-ended, and frustrum-shaped faucet body intermediate flange portion
232 faucet body intermediate flange portion open lower end
234 faucet body intermediate flange portion open upper end
240 hollow, open-ended, and inverted J-shaped overhead faucet body arm
241 open faucet body overhead arm proximal end
242 hollow, open-ended, and slightly frustrum-shaped faucet body upper portion
243 faucet body upper portion upper laterally-disposed throughbore
244 faucet body upper portion open lower end
245 faucet body upper portion lower laterally-disposed throughbore
246 externally-threaded faucet body upper portion open upper end
247 hollow, open-ended, and cylindrically-shaped faucet body valve housing
248 conventional valve assembly
249 faucet body valve housing open proximal end
251 faucet body valve housing open distal end
250 by a hollow and open-ended packing lock fitting
252 hollow, open-ended, and frustrum-shaped packing lock fitting upper portion
253 hollow, open-ended, and cylindrically-shaped faucet body sprinkler housing
254 hollow, open-ended, internally-threaded, and octagon-shaped packing lock fitting lower portion
255 faucet body sprinkler housing open proximal end
261 internally-disposed metering assembly
263 hollow, open front, substantially closed top and bottom, and parallelepiped-shaped internally-disposed metering assembly enclosure
265 substantially closed metering assembly enclosure top
267 substantially closed metering assembly enclosure bottom
269 open metering assembly enclosure front
270 longitudinally-oriented, centrally-disposed, and internally-threaded metering assembly throughbore
272 longitudinally-oriented and externally-threaded metering assembly allen screw
298 faucet body valve housing open sprinkler end
300 water source arrows
301 body water arrows
303 arm water arrows
304 spout water arrows
306 shower water arrow

DETAILED DESCRIPTION OF THE PREFERRED EMBODIMENT

Referring now to the figures in which like numerals indicate like parts, and particularly to FIG. 1, the self-cleaning knob water faucet of the present invention is shown generally at 10, in place of a conventional-type water faucet (not shown), on a sink 12 and showering water 14 onto a knob 15 of the self-cleaning knob water faucet 10. The showering water 14 is a diverted part of spout water 16 flowing from a spout 18 for washing a pair of user hands 20 of a user 22.

Figure 2:
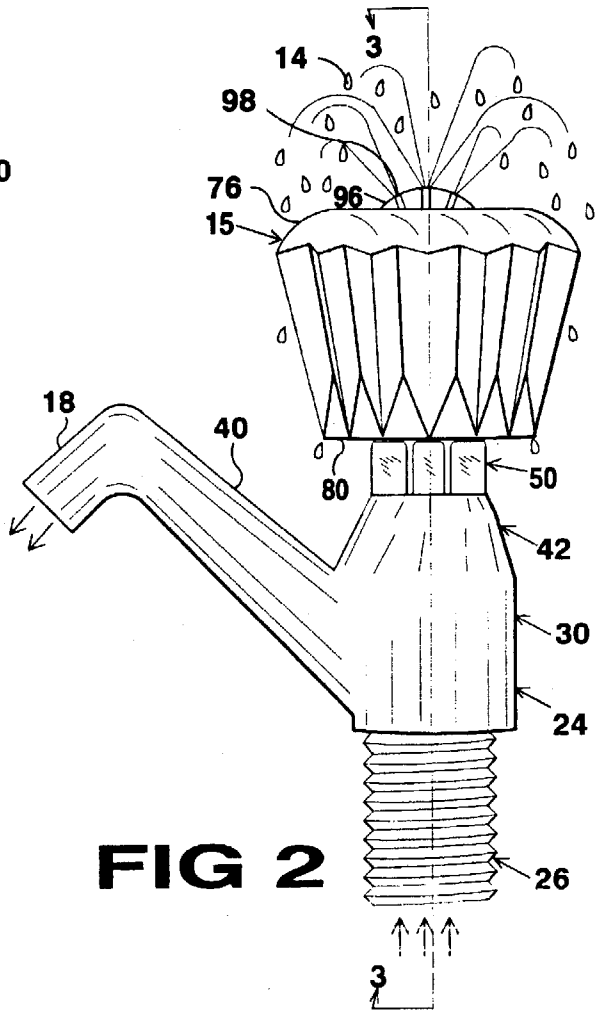
FIG. 2 is a diagrammatic side elevational view of a first specific embodiment of the present invention.
Figure 3:
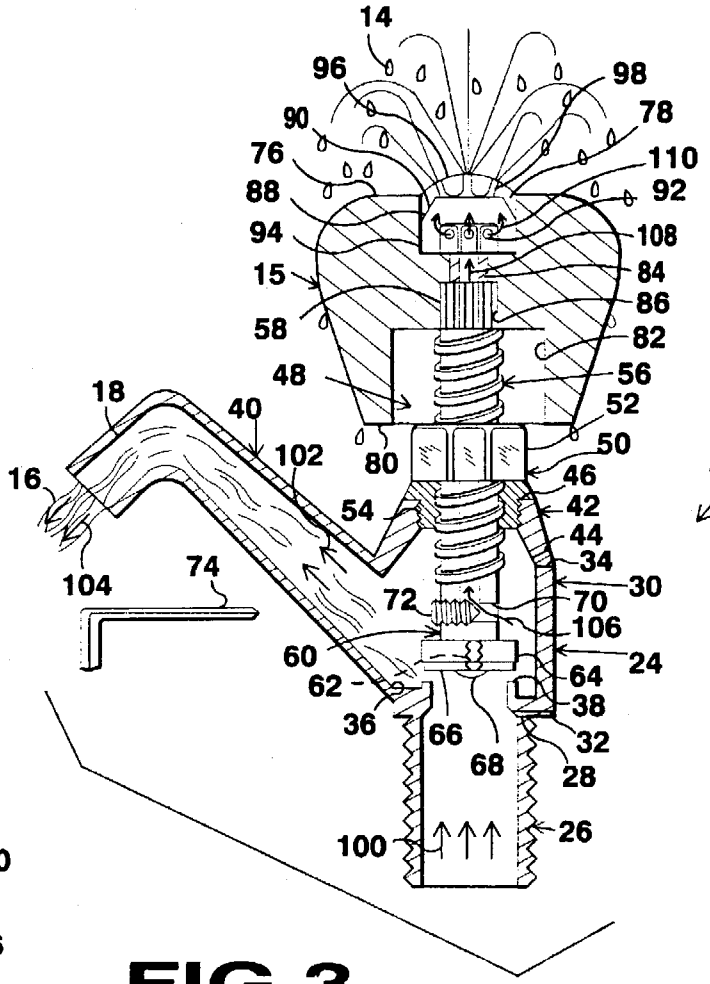
FIG. 3 is a partial cross sectional view taken on line 3—3 in FIG. 2.

The configuration of a first specific embodiment of the self-cleaning knob water faucet 10 can best be seen in FIGS. 2 and 3, and as such, will be discussed with reference thereto.

The self-cleaning knob water faucet 10 includes a hollow faucet body 24 having a hollow, open-ended, externally-threaded, and cylindrically-shaped faucet body lower portion 26 with a faucet body lower portion diameter and a faucet body lower portion open upper end 28.

The hollow faucet body 24 further has a hollow, open-ended, and cylindrically-shaped faucet body intermediate portion 30 with a faucet body intermediate portion diameter, a faucet body intermediate portion open lower end 32, a faucet body intermediate portion open upper end 34, and a faucet body intermediate portion lateral throughbore 36.

The hollow, open-ended, and cylindrically-shaped faucet body intermediate portion 30 of the hollow faucet body 24, at the faucet body intermediate portion open lower end 32 of the hollow, open-ended, and cylindrically-shaped faucet body intermediate portion 30 of the hollow faucet body 24, is integral with and extends upwardly form the faucet body lower portion open upper end 28 of the hollow, open-ended, externally-threaded, and cylindrically-shaped faucet body lower portion 26 of the hollow faucet body 24.

The interior space of the hollow, open-ended, and cylindrically-shaped faucet body intermediate portion 30 of the hollow faucet body 24 is in direct fluid communication with the interior space of the hollow, open-ended, externally-threaded, and cylindrically-shaped faucet body lower portion 26 of the hollow faucet body 24, via the faucet body intermediate portion open lower end 32 of the hollow, open-ended, and cylindrically-shaped faucet body intermediate portion 30 of the hollow faucet body 24 and the faucet body lower portion open upper end 28 of the hollow, open-ended, externally-threaded, and cylindrically-shaped faucet body lower portion 26 of the hollow faucet body 24.

The faucet body intermediate portion diameter of the hollow, open-ended, and cylindrically-shaped faucet body intermediate portion 30 of the hollow faucet body 24 is greater than the faucet body lower portion diameter of the hollow, open-ended, externally-threaded, and cylindrically-shaped faucet body lower portion 26 of the hollow faucet body 24, so that the faucet body intermediate portion open lower end 32 of the hollow, open-ended, and cylindrically-shaped faucet body intermediate portion 30 of the hollow faucet body 24 can rest on the sink 12. The hollow faucet body 24 further has an internally-disposed faucet body valve seat 38 disposed internally to the hollow faucet body 24, at substantially the point where the hollow, open-ended, and cylindrically-shaped faucet body intermediate portion 30 of the hollow faucet body 24 meets the hollow, open-ended, externally-threaded, and cylindrically-shaped faucet body lower portion 26 of the hollow faucet body 24.

The hollow faucet body 24 further has a hollow faucet body arm 40 that terminates in the spout 18 and extends outwardly and upwardly from the faucet body intermediate portion lateral throughbore perimeter of the faucet body intermediate portion lateral throughbore 36 of the hollow, open-ended, and cylindrically-shaped faucet body intermediate portion 30 of the hollow faucet body 24.

The interior space of the hollow faucet body arm 40 of the hollow faucet body 24 is in direct fluid communication with the interior space of the hollow, open-ended, and cylindrically-shaped faucet body intermediate portion 30 of the hollow faucet body 24, via the faucet body intermediate portion lateral throughbore 36 of the hollow, open-ended, and cylindrically-shaped faucet body intermediate portion 30 of the hollow faucet body 24, via the faucet body intermediate portion lateral throughbore 36 of the hollow, open-ended, and cylindrically-shaped faucet body intermediate portion 30 of the hollow faucet body 24.

The hollow faucet body 24 further has a hollow, open-ended, internally-threaded, and frustrum-shaped faucet body upper portion 42 with a faucet body upper portion open lower end 44, and a faucet body upper portion open upper end 46.

The hollow, open-ended, internally-threaded, and frustrum-shaped faucet body upper portion 42 of the hollow faucet body 24, at the faucet body upper portion open lower end 44 of the hollow, open-ended, internally-threaded, and frustrum-shaped faucet body upper portion 42 of the hollow faucet body 24, is integral with and tapers upwardly from the faucet body intermediate portion open upper end 34 of the hollow, open-ended, and cylindrically-shaped faucet body intermediate portion 30 of the hollow faucet body 24.

The interior space of the hollow, open-ended, and cylindrically-shaped faucet body intermediate portion 30 of the hollow faucet body 24 is in direct fluid communication with the interior space of the hollow, open-ended, internally-threaded, and frustrum-shaped faucet body upper portion 42 of the hollow faucet body 24, via the faucet body intermediate portion open upper end 34 of the hollow, open-ended, and cylindrically-shaped faucet body intermediate portion 30 of the hollow faucet body 24 and the faucet body upper portion open lower end 44 of the hollow, open-ended, internally-threaded, and frustrum-shaped faucet body upper portion 42 of the hollow faucet body 24.

The self-cleaning knob water faucet 10 further includes a valve assembly 48 that enters the interior space of the hollow faucet body 24, through the faucet body upper portion open upper end 46 of the hollow, open-ended, internally-threaded, and frustrum-shaped faucet body upper portion 42 of the hollow faucet body 24, and is removably secured thereto by a hollow and open-ended packing lock fitting 50.

The hollow and open-ended packing lock fitting 50 has a hollow, open-ended, and octagon-shaped packing lock fitting upper portion 52, so that the hollow and open-ended packing lock fitting 50 can be readily turned by a conventional tool.

The hollow and open-ended packing lock fitting 50 further has a hollow, open-ended, internally and externally-threaded, and cylindrically-shaped packing lock fitting lower portion 54 that is integral with, and extends downwardly from, the hollow, open-ended, and octagon-shaped packing lock fitting upper portion 52 of the hollow and open-ended packing lock fitting 50 and whose external threads threadably mate with internal threads of the hollow, open-ended, internally-threaded, and frustrum-shaped faucet body upper portion 42 of the hollow faucet body 24, so that the valve assembly 48 can be readily removably secured to the hollow faucet body 24.

The interior space of the hollow, open-ended, and octagon-shaped packing lock fitting upper portion 52 of the hollow and open-ended packing lock fitting 50 is in direct fluid communication with the interior space of the hollow, open-ended, internally and externally-threaded, and cylindrically-shaped packing lock fitting lower portion 54 of the hollow and open-ended packing lock fitting 50.

The valve assembly 48 includes a hollow, longitudinally-oriented, externally-threaded, cylindrically-shaped, and slender valve assembly stem 56 that has a hollow and internally-threaded valve assembly stem upper end 58, and a valve assembly stem lower end sub-assembly 60 that is disposed in the interior space of the hollow faucet body 24.

The external threads of the hollow, longitudinally-oriented, externally-threaded, cylindrically-shaped, and slender valve assembly stem 56 of the valve assembly 48 threadably engage the internal threads of the hollow, open-ended, internally and externally-threaded, and cylindrically-shaped packing lock fitting lower portion 54 of the hollow and open-ended packing lock fitting 50, so that the hollow, longitudinally-oriented, externally-threaded, cylindrically-shaped, and slender valve assembly stem 56 of the valve assembly 48 can thread up and down relative to the hollow faucet body 24 and allow the self-cleaning knob water faucet to achieve an open and a closed position.

The valve assembly stem lower end sub-assembly 60 of the hollow, longitudinally-oriented, externally-threaded, cylindrically-shaped, and slender valve assembly stem 56 of the valve assembly 48 has a longitudinally-oriented, centrally-disposed, and internally-threaded valve assembly stem lower end sub-assembly bore 62 that extends partially therein with its longitudinal axis collinear with the longitudinal axis of the hollow, longitudinally-oriented, externally-threaded, cylindrically-shaped, and slender valve assembly stem 56 of the valve assembly 48.

The valve assembly stem lower end sub-assembly 60 of the hollow, longitudinally-oriented, externally-threaded, cylindrically-shaped, and slender valve assembly stem 56 of the valve assembly 48 further has a laterally-disposed and cup-shaped valve assembly stem lower end sub-assembly washer receptacle 64 whose center is in alignment with the longitudinally-oriented, centrally-disposed, and internally-threaded valve assembly stem lower end sub-assembly bore 62 of the valve assembly stem lower end sub-assembly 60 of the hollow, longitudinally-oriented, externally-threaded, cylindrically-shaped, and slender valve assembly stem 56 of the valve assembly 48.

The valve assembly stem lower end sub-assembly 60 of the hollow, longitudinally-oriented, externally-threaded, cylindrically-shaped, and slender valve assembly stem 56 of the valve assembly 48 further has a valve assembly stem lower end sub-assembly washer 66, so that the valve assembly stem lower end sub-assembly washer 66 of the valve assembly stem lower end sub-assembly 60 of the hollow, longitudinally-oriented, externally-threaded, cylindrically-shaped, and slender valve assembly stem 56 of the valve assembly 48 provides a seal when in contact with the internally-disposed faucet body valve seat 38 of the hollow faucet body 24.

The valve assembly stem lower end sub-assembly washer 66 of the valve assembly stem lower end sub-assembly 60 of the hollow, longitudinally-oriented, externally-threaded, cylindrically-shaped, and slender valve assembly stem 56 of the valve assembly 48 is removably mounted in the laterally-disposed and cup-shaped valve assembly stem lower end sub-assembly washer receptacle 64 of the hollow, longitudinally-oriented, externally-threaded, cylindrically-shaped, and slender valve assembly stem 56 of the valve assembly stem lower end sub-assembly 60 of the valve assembly 48, by a valve assembly stem lower end sub-assembly washer threaded screw 68 that threadably mates with the longitudinally-oriented, centrally-disposed, and internally-threaded valve assembly stem lower end sub-assembly bore 62 of the valve assembly stem lower end sub-assembly 60 of the hollow, longitudinally-oriented, externally-threaded, cylindrically-shaped, and slender valve assembly stem 56 of the valve assembly 48, so that the valve assembly stem lower end sub-assembly washer 66 of the valve assembly stem lower end sub-assembly 60 of the hollow, longitudinally-oriented, externally-threaded, cylindrically-shaped, and slender valve assembly stem 56 of the valve assembly 48 can be readily replaced.

The valve assembly stem lower end sub-assembly 60 of the hollow, longitudinally-oriented, externally-threaded, cylindrically-shaped, and slender valve assembly stem 56 of the valve assembly 48 further has a laterally-oriented and internally-threaded valve assembly stem lower end sub-assembly metering throughbore 70 that passes completely through the hollow, longitudinally-oriented, externally-threaded, cylindrically-shaped, and slender valve assembly stem 56 of the valve assembly 48.

The laterally-oriented and internally-threaded valve assembly stem lower end sub-assembly metering throughbore 70 of the valve assembly stem lower end sub-assembly 60 of the hollow, longitudinally-oriented, externally-threaded, cylindrically-shaped, and slender valve assembly stem 56 of the valve assembly 48 is disposed above the laterally-disposed and cup-shaped valve assembly stem lower end sub-assembly washer receptacle 64 of the hollow, longitudinally-oriented, externally-threaded, cylindrically-shaped, and slender valve assembly stem 56 of the valve assembly stem lower end sub-assembly 60 of the valve assembly 48 and opens into both the interior space of the hollow, longitudinally-oriented, externally-threaded, cylindrically-shaped, and slender valve assembly stem 56 of the valve assembly 48 and the interior space of the hollow faucet body 14 so as to be in direct fluid communication therewith.

The hollow valve assembly stem lower end sub-assembly 60 of the hollow, longitudinally-oriented, externally-threaded, cylindrically-shaped, and slender valve assembly stem 56 of the valve assembly 48 further has a laterally-oriented and externally-threaded valve assembly stem lower end sub-assembly metering allen screw 72 that threadably mates with the laterally-oriented and internally-threaded valve assembly stem lower end sub-assembly metering throughbore 70 of the valve assembly stem lower end sub-assembly 60 of the hollow, longitudinally-oriented, externally-threaded, cylindrically-shaped, and slender valve assembly stem 56 of the valve assembly 48, so that the amount of direct fluid communication between the interior space of the hollow faucet body 24 and the interior space of the hollow, longitudinally-oriented, externally-threaded, cylindrically-shaped, and slender valve assembly stem 56 of the valve assembly 48 can be readily adjusted.

The laterally-oriented and externally-threaded valve assembly stem lower end sub-assembly metering allen screw 72 is a non-corrosive material, such as but not limited, to plastic or the like.

The laterally-oriented and externally-threaded valve assembly stem lower end sub-assembly metering allen screw 72 of the valve assembly stem lower end sub-assembly 60 of the hollow, longitudinally-oriented, externally-threaded, cylindrically-shaped, and slender valve assembly stem 56 of the valve assembly 48 is moved relative to the laterally-oriented and internally-threaded valve assembly stem lower end sub-assembly metering throughbore 70 of the valve assembly stem lower end sub-assembly 60 of the hollow, longitudinally-oriented, externally-threaded, cylindrically-shaped, and slender valve assembly stem 56 of the valve assembly 48, by a standard allen key 74.

The knob 15 has a knob upper surface 76 with a longitudinally-oriented, centrally-disposed, and cylindrically-shaped knob upper surface chamber 78 that opens into the knob upper surface 76 of the knob 15 and whose longitudinal axis is collinear with the longitudinal axis of the hollow, longitudinally-oriented, externally-threaded, cylindrically-shaped, and slender valve assembly stem 56 of the valve assembly 48.

The knob 15 further has a knob lower surface 80 with a longitudinally-oriented, centrally-disposed, and cylindrically-shaped knob lower surface chamber 82 that opens into the knob lower surface 80 of the knob 15 and whose longitudinal axis is collinear with the longitudinal axis of the hollow, longitudinally-oriented, externally-threaded, cylindrically-shaped, and slender valve assembly stem 56 of the valve assembly 48.

The diameter of the longitudinally-oriented, centrally-disposed, and cylindrically-shaped knob lower surface chamber 82 of the knob lower surface 80 of the knob 15 is greater than both the diameter of the longitudinally-oriented, centrally-disposed, and cylindrically-shaped knob upper surface chamber 78 of the knob upper surface 76 of the knob 15 and the diameter of the hollow, longitudinally-oriented, externally-threaded, cylindrically-shaped, and slender valve assembly stem 56 of the valve assembly 48.

The knob 15 further has a longitudinally-oriented, centrally-disposed, and cylindrically-shaped knob upper intermediate chamber 84 that opens into the longitudinally-oriented, centrally-disposed, and cylindrically-shaped knob upper surface chamber 78 of the knob upper surface 76 of the knob 15 and whose longitudinal axis is collinear with the longitudinal axis of the hollow, longitudinally-oriented, externally-threaded, cylindrically-shaped, and slender valve assembly stem 56 of the valve assembly 48.

The diameter of the longitudinally-oriented, centrally-disposed, and cylindrically-shaped knob upper intermediate chamber 84 of the knob 15 is less than the diameter of the longitudinally-oriented, centrally-disposed, and cylindrically-shaped knob upper surface chamber 78 of the knob upper surface 76 of the knob 15.

The knob 15 further has a longitudinally-oriented and centrally-disposed knob lower intermediate chamber 86 that opens into both the longitudinally-oriented, centrally-disposed, and cylindrically-shaped knob upper intermediate chamber 84 of the knob 15 and the longitudinally-oriented, centrally-disposed, and cylindrically-shaped knob lower surface chamber 82 of the knob lower surface 80 of the knob 15 and whose longitudinal axis is collinear with the longitudinal axis of the hollow, longitudinally-oriented, externally-threaded, cylindrically-shaped, and slender valve assembly stem 56 of the valve assembly 48.

The diameter of the longitudinally-oriented and centrally-disposed knob lower intermediate chamber 86 of the knob 15 is greater than the diameter of the longitudinally-oriented, centrally-disposed, and cylindrically-shaped knob upper intermediate chamber 84 of the knob 15.

The longitudinally-oriented and centrally-disposed knob lower intermediate chamber 86 of the knob 15 securely receives the hollow and internally-threaded valve assembly stem upper end 58 of the hollow, longitudinally-oriented, externally-threaded, cylindrically-shaped, and slender valve assembly stem 56 of the valve assembly 48.

The knob 15 is removably secured to the valve assembly 48 by a knob mounting bolt 88.

The knob mounting bolt 88 has a hollow, open-ended, and octagon-shaped knob mounting bolt upper portion 90, so that the knob mounting bolt 88 can be readily turned by a conventional tool.

The hollow, open-ended, and octagon-shaped knob mounting bolt upper portion 90 of the knob mounting bolt 88 has a plurality of radially-disposed knob mounting bolt upper portion channels 92 that open into both the interior space of the hollow, open-ended, and octagon-shaped knob mounting bolt upper portion 90 of the knob mounting bolt 88 and the longitudinally-oriented, centrally-disposed, and cylindrically-shaped knob upper surface chamber 78 of the knob upper surface 76 of the knob 15.

The plurality of radially-disposed knob mounting bolt upper portion channels 92 of the hollow, open-ended, and octagon-shaped knob mounting bolt upper portion 90 of the knob mounting bolt 88 are in direct fluid communication with both the interior space of the hollow, open-ended, and octagon-shaped knob mounting bolt upper portion 90 of the knob mounting bolt 88 and the longitudinally-oriented, centrally-disposed, and cylindrically-shaped knob upper surface chamber 78 of the knob upper surface 76 of the knob 15.

The diameter of the hollow, open-ended, and octagon-shaped knob mounting bolt upper portion 90 of the knob mounting bolt 88 is greater than the diameter of the longitudinally-oriented, centrally-disposed, and cylindrically-shaped knob upper intermediate chamber 84 of the knob 15, so that the knob mounting bolt will not pass therethrough.

The knob mounting bolt 88 further has a hollow, open-ended, externally-threaded, and cylindrically-shaped knob mounting bolt lower portion 94 that is integral with, and extends downwardly from, the hollow, open-ended, and octagon-shaped knob mounting bolt upper portion 90 of the knob mounting bolt 88.

The interior space of the hollow, open-ended, externally-threaded, and cylindrically-shaped knob mounting bolt lower portion of the knob mounting bolt 88 is in direct fluid communication with the interior space of the hollow, open-ended, and octagon-shaped knob mounting bolt upper portion 90 of the knob mounting bolt 88.

The hollow, open-ended, externally-threaded, and cylindrically-shaped knob mounting bolt lower portion 94 of the knob mounting bolt 88 passes through the longitudinally-oriented, centrally-disposed, and cylindrically-shaped knob upper intermediate chamber 84 of the knob 15 and threadably mates with the hollow and internally-threaded valve assembly stem upper end 58 of the hollow, longitudinally-oriented, externally-threaded, cylindrically-shaped, and slender valve assembly stem 56 of the valve assembly 48, so that the knob 15 can be readily removably secured to the hollow, longitudinally-oriented, externally-threaded, cylindrically-shaped, and slender valve assembly stem 56 of the valve assembly 48.

The interior space of the hollow, open-ended, externally-threaded, and cylindrically-shaped knob mounting bolt lower portion 94 of the knob mounting bolt 88 is in direct fluid communication with the interior space of the hollow, longitudinally-oriented, externally-threaded, cylindrically-shaped, and slender valve assembly stem 56 of the valve assembly 48.

The self-cleaning knob water faucet 10 further includes a convexo-concave-shaped decorative button 96 that has a plurality of radially-disposed button sprinkler channels 98.

The plurality of radially-disposed button sprinkler channels 98 of the convexo-concave-shaped decorative button 96 open into both the ambient and the longitudinally-oriented, centrally-disposed, and cylindrically-shaped knob upper surface chamber 78 of the knob upper surface 76 of the knob 15.

The plurality of radially-disposed button sprinkler channels 98 of the convexo-concave-shaped decorative button 96 are in direct fluid communication with both the ambient and the longitudinally-oriented, centrally-disposed, and cylindrically-shaped knob upper surface chamber 78 of the knob upper surface 76 of the knob 15.

The operation of the first embodiment of the self-cleaning knob water faucet 10 can best be seen in FIG. 3, and as such, will be discussed with reference thereto.

Water from a water source enters the hollow, open-ended, externally-threaded, and cylindrically-shaped faucet body lower portion 26 of the hollow faucet body 24, in the direction of water source arrows 100.

When the self-cleaning knob water faucet 10 is in the open position, that is, when the valve assembly stem lower end sub-assembly 60 of the hollow, longitudinally-oriented, externally-threaded, cylindrically-shaped, and slender valve assembly stem 56 of the valve assembly 48 is displaced upward from, and not in contact with, the internally-disposed faucet body valve seat 38 of the hollow faucet body 24, the water passes through the internally-disposed faucet body valve seat 38 of the hollow faucet body 24 and enters the hollow, open-ended, and cylindrically-shaped faucet body intermediate portion 30 of the hollow faucet body 24.

Once the water enters the hollow, open-ended, and cylindrically-shaped faucet body intermediate portion 30 of the hollow faucet body 24, it is divided into two parts.

A first and larger part of the water enters the hollow faucet body arm 40 of the hollow faucet body 24, in the direction of arm water arrows 102. The spout water 16 exits the spout 18 in the direction of spout water arrows 104.

The remaining and smaller part of the water enters and passes through the laterally-oriented and internally-threaded valve assembly stem lower end sub-assembly metering throughbore 70 of the valve assembly stem lower end sub-assembly 60 of the hollow, longitudinally-oriented, externally-threaded, cylindrically-shaped, and slender valve assembly stem 56 of the valve assembly 48, in the direction of valve assembly water arrow 106.

The water passing through the laterally-oriented and internally-threaded valve assembly stem lower end sub-assembly metering throughbore 70 of the valve assembly stem lower end sub-assembly 60 of the hollow, longitudinally-oriented, externally-threaded, cylindrically-shaped, and slender valve assembly stem 56 of the valve assembly 48 enters and travels upwardly through the interior space of the hollow, longitudinally-oriented, externally-threaded, cylindrically-shaped, and slender valve assembly stem 56 of the valve assembly 48.

The water traveling upwardly through the interior space of hollow, longitudinally-oriented, externally-threaded, cylindrically-shaped, and slender valve assembly stem 56 of the valve assembly 48 enters and passes through the interior space of the hollow, open-ended, externally-threaded, and cylindrically-shaped knob mounting bolt lower portion 94 of the knob mounting bolt 88, in the direction of bolt water arrow 108.

The water passing through the interior space of the hollow, open-ended, externally-threaded, and cylindrically-shaped knob mounting bolt lower portion 94 of the knob mounting bolt 88 enters and passes through the plurality of radially-disposed knob mounting bolt upper portion channels 92 of the hollow, open-ended, and octagon-shaped knob mounting bolt upper portion 90 of the knob mounting bolt 88.

The water passing through the plurality of radially-disposed knob mounting bolt upper portion channels 92 of the hollow, open-ended, and octagon-shaped knob mounting bolt upper portion 90 of the knob mounting bolt 88 enter and passes through the longitudinally-oriented, centrally-disposed, and cylindrically-shaped knob upper surface chamber 78 of the knob upper surface 76 of the knob 15, in the direction of knob water arrows 110.

The water passing through the longitudinally-oriented, centrally-disposed, and cylindrically-shaped knob upper surface chamber 78 of the knob upper surface 76 of the knob 15 enters and passes through the plurality of radially-disposed button sprinkler channels 98 of the convexo-concave-shaped decorative button 96, where it becomes the showering water 14 and self-cleans the knob 15.

To adjust the amount of water entering the valve assembly and ultimately the amount of water that is going to clean the knob 15, the hollow and open-ended packing lock fitting 50 is loosened and the valve assembly 48 is removed from the hollow faucet body 24.

The allen key 74 is used to position the laterally-oriented and externally-threaded valve assembly stem lower end sub-assembly metering allen screw 72 of the valve assembly stem lower end sub-assembly 60 of the hollow, longitudinally-oriented, externally-threaded, cylindrically-shaped, and slender valve assembly stem 56 of the valve assembly 48 in the laterally-oriented and internally-threaded valve assembly stem lower end sub-assembly metering throughbore 70 of the valve assembly stem lower end sub-assembly 60 of the hollow, longitudinally-oriented, externally-threaded, cylindrically-shaped, and slender valve assembly stem 56 of the valve assembly 48.

Figure 4:
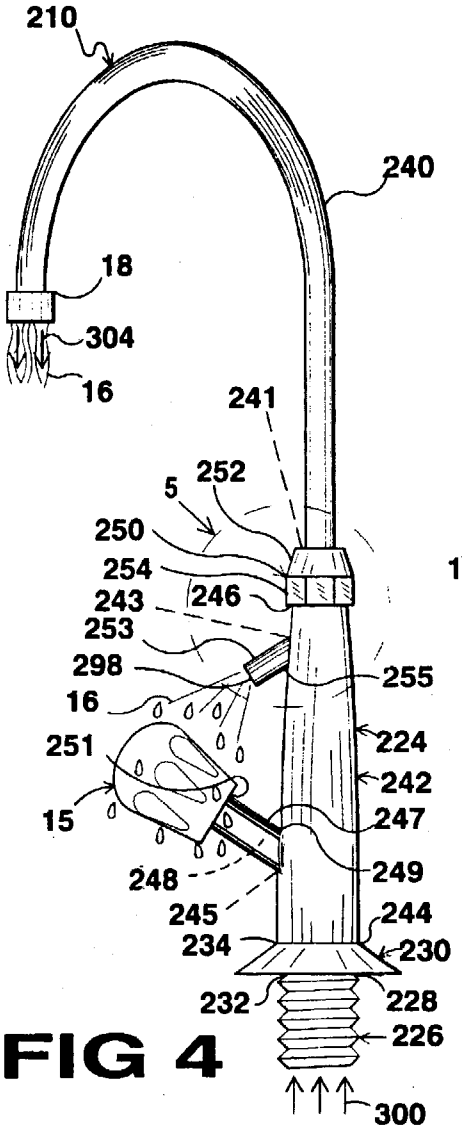
FIG. 4 is a diagrammatic side elevational view of a second specific embodiment of the present invention.

The configuration of a second specific embodiment of the self-cleaning knob water faucet 210 can best be seen in FIGS. 4 and 5, and as such, will be discussed with reference thereto.

The self-cleaning knob water faucet 210 of the present invention includes a hollow faucet body 224 having a hollow, open-ended, externally-threaded, and cylindrically-shaped faucet body lower portion 226 with a faucet body lower portion diameter and a faucet body lower portion open upper end 228.

The hollow faucet body 224 further has a hollow, open-ended, and frustrum-shaped faucet body intermediate flange portion 230 with a faucet body intermediate flange portion diameter, a faucet body intermediate flange portion open lower end 232, and a faucet body intermediate flange portion open upper end 234.

The hollow, open-ended, and cylindrically-shaped faucet body intermediate flange portion 230 of the hollow faucet body 224, at the faucet body intermediate flange portion open lower end 232 of the hollow, open-ended, and cylindrically-shaped faucet body intermediate flange portion 230 of the hollow faucet body 224, is integral with and extends upwardly form the faucet body lower portion open upper end 228 of the hollow, open-ended, externally-threaded, and cylindrically-shaped faucet body lower portion 226 of the hollow faucet body 224.

The interior space of the hollow, open-ended, and cylindrically-shaped faucet body intermediate flange portion 230 of the hollow faucet body 224 is in direct fluid communication with the interior space of the hollow, open-ended, externally-threaded, and cylindrically-shaped faucet body lower portion 226 of the hollow faucet body 224, via the faucet body intermediate flange portion open lower end 232 of the hollow, open-ended, and cylindrically-shaped faucet body intermediate flange portion 230 of the hollow faucet body 224 and the faucet body lower portion open upper end 228 of the hollow, open-ended, externally-threaded, and cylindrically-shaped faucet body lower portion 226 of the hollow faucet body 224.

The diameter of the faucet body intermediate flange portion open lower end 232 of the hollow, open-ended, and cylindrically-shaped faucet body intermediate flange portion 230 of the hollow faucet body 224 is greater than the faucet body lower portion diameter of the hollow, open-ended, externally-threaded, and cylindrically-shaped faucet body lower portion 226 of the hollow faucet body 224, so that the faucet body intermediate flange portion open lower end 232 of the hollow, open-ended, and cylindrically-shaped faucet body intermediate flange portion 230 of the hollow faucet body 224 can rest on the sink 12.

The hollow faucet body 224 further has a hollow, open-ended, and slightly frustrum-shaped faucet body upper portion 242 with a faucet body upper portion upper laterally-disposed throughbore 243, a faucet body upper portion open lower end 244, a faucet body upper portion lower laterally-disposed throughbore 245, and an externally-threaded faucet body upper portion open upper end 246.

The hollow, open-ended, and slightly frustrum-shaped faucet body upper portion 242 of the hollow faucet body 224, at the faucet body upper portion open lower end 244 of the hollow, open-ended, and slightly frustrum-shaped faucet body upper portion 242 of the hollow faucet body 224, is integral with and tapers slightly upwardly from the faucet body intermediate flange portion open upper end 234 of the hollow, open-ended, and cylindrically-shaped faucet body intermediate flange portion 230 of the hollow faucet body 224.

The interior space of the hollow, open-ended, and 1 cylindrically-shaped faucet body intermediate flange portion 230 of the hollow faucet body 224 is in direct fluid communication with the interior space of the hollow, open-ended, and slightly frustrum-shaped faucet body upper portion 242 of the hollow faucet body 224, via the faucet body upper portion open lower end 244 of the hollow, open-ended, and slightly frustrum-shaped faucet body upper portion 242 of the hollow faucet body 224 and the faucet body intermediate flange portion open upper end 234 of the hollow, open-ended, and cylindrically-shaped faucet body intermediate flange portion 230 of the hollow faucet body 224.

The hollow faucet body 224 further has a hollow, open-ended, and inverted J-shaped overhead faucet body arm 240 that terminates in the spout 18 and originates at an open faucet body overhead arm proximal end 241.

The hollow, open-ended, and inverted J-shaped overhead faucet body arm 240 of the hollow faucet body 224, at the open faucet body overhead arm proximal end 241 of the hollow, open-ended, and inverted J-shaped overhead faucet body arm 240 of the hollow faucet body 224, extends upwardly from, and is removably mounted to, the externally-threaded faucet body upper portion open upper end 246 of the hollow, open-ended, and slightly frustrum-shaped faucet body upper portion 242 of the hollow faucet body 224.

The interior space of the hollow, open-ended, and inverted J-shaped overhead faucet body arm 240 of the hollow faucet body 224 is in direct fluid communication with the interior space of the hollow, open-ended, and slightly frustrum-shaped faucet body upper portion 242 of the hollow faucet body 224, via the open faucet body overhead arm proximal end 241 of the hollow, open-ended, and inverted J-shaped overhead faucet body arm 240 of the hollow faucet body 224 and the externally-threaded faucet body upper portion open upper end 246 of the hollow, open-ended, and slightly frustrum-shaped faucet body upper portion 242 of the hollow faucet body 224.

The open faucet body overhead arm proximal end 241 of the hollow, open-ended, and inverted J-shaped overhead faucet body arm 240 of the hollow faucet body 224 is removably mounted to the externally-threaded faucet body upper portion open upper end 246 of the hollow, open-ended, and slightly frustrum-shaped faucet body upper portion 242 of the hollow faucet body 224, by a hollow and open-ended packing lock fitting 250.

The hollow and open-ended packing lock fitting 250 has a hollow, open-ended, and frustrum-shaped packing lock fitting upper portion 252.

The hollow and open-ended packing lock fitting 250 further has a hollow, open-ended, internally-threaded, and octagon-shaped packing lock fitting lower portion 254 that is integral with, and extends downwardly from, the hollow, open-ended, and frustrum-shaped packing lock fitting upper portion 252 of the hollow and open-ended packing lock fitting 250, so that the hollow and open-ended packing lock fitting 250 can be readily turned by a conventional tool.

The internal threads of the hollow, open-ended, internally-threaded, and octagon-shaped packing lock fitting lower portion 254 of the hollow and open-ended packing lock fitting 250 threadably mate with the external threads of the externally-threaded faucet body upper portion open upper end 246 of the hollow, open-ended, and slightly frustrum-shaped faucet body upper portion 242 of the hollow faucet body 224, so that the hollow, open-ended, and inverted J-shaped overhead faucet body arm 240 of the hollow faucet body 224 can be readily removably secured to the hollow faucet body 224.

The interior space of the hollow, open-ended, internally-threaded, and octagon-shaped packing lock fitting lower portion 254 of the hollow and open-ended packing lock fitting 250 is in direct fluid communication with the interior space of the hollow, open-ended, and frustrum-shaped packing lock fitting upper portion 252 of the hollow and open-ended packing lock fitting 250.

The hollow faucet body 224 further has a hollow, open-ended, and cylindrically-shaped faucet body valve housing 247 with a faucet body valve housing open proximal end 249 and a faucet body valve housing open distal end 251.

The hollow, open-ended, and cylindrically-shaped faucet body valve housing 247 of the hollow faucet body 224, at the faucet body valve housing open proximal end 249 of the hollow, open-ended, and cylindrically-shaped faucet body valve housing 247 of the hollow faucet body 224, extends outwardly and upwardly from the perimeter of the faucet body upper portion lower laterally-disposed throughbore 245 of the hollow, open-ended, and slightly frustrum-shaped faucet body upper portion 242 of the hollow faucet body 224.

The interior space of the hollow, open-ended, and cylindrically-shaped faucet body valve housing 247 of the hollow faucet body 224 is in direct fluid communication with the interior space of the hollow, open-ended, and slightly frustrum-shaped faucet body upper portion 242 of the hollow faucet body 224, via the faucet body upper portion lower laterally-disposed throughbore 245 of the hollow, open-ended, and slightly frustrum-shaped faucet body upper portion 242 of the hollow faucet body 224.

The hollow faucet body 224 further has a hollow, open-ended, and cylindrically-shaped faucet body sprinkler housing 253 with a faucet body sprinkler housing open proximal end 255, and a faucet body valve housing open sprinkler end 298.

The hollow, open-ended, and cylindrically-shaped faucet body sprinkler housing 253 of the hollow faucet body 224 is disposed above the hollow, open-ended, and cylindrically-shaped faucet body valve housing 247 of the hollow faucet body 224.

The hollow, open-ended, and cylindrically-shaped faucet body sprinkler housing 253 of the hollow faucet body 224, at the faucet body sprinkler housing open proximal end 255 of the hollow, open-ended, and cylindrically-shaped faucet body sprinkler housing 253 of the hollow faucet body 224, extends outwardly and downwardly from the perimeter of the faucet body upper portion upper laterally-disposed throughbore 243 of the hollow, open-ended, and slightly frustrum-shaped faucet body upper portion 242 of the hollow faucet body 224.

The interior space of the hollow, open-ended, and cylindrically-shaped faucet body sprinkler housing 253 of the hollow faucet body 224 is in direct fluid communication with the interior space of the hollow, open-ended, and slightly frustrum-shaped faucet body upper portion 242 of the hollow faucet body 224, via the faucet body upper portion upper laterally-disposed throughbore 243 of the hollow, open-ended, and slightly frustrum-shaped faucet body upper portion 242 of the hollow faucet body 224.

The self-cleaning knob water faucet 210 further includes a conventional valve assembly 248 that extends through the hollow, open-ended, and cylindrically-shaped faucet body valve housing 247 of the hollow faucet body 224 and into the hollow, open-ended, and slightly frustrum-shaped faucet body upper portion 242 of the hollow faucet body 224.

The knob 15 is disposed at the faucet body valve housing open distal end 251 of the hollow, open-ended, and cylindrically-shaped faucet body valve housing 247 of the hollow faucet body 224 and is connected to the conventional valve assembly 248 and operatively rotates as a unit therewith.

The outwardly and downwardly orientation of the hollow, open-ended, and cylindrically-shaped faucet body sprinkler housing 253 of the hollow faucet body 224 is such that water exiting the faucet body valve housing open sprinkler end 298 of the hollow, open-ended, and cylindrically-shaped faucet body sprinkler housing 253 of the hollow faucet body will impact on the knob 15, and clean the knob 15.

As show in FIG. 5, an internally-disposed metering assembly 261 is disposed in the hollow, open-ended, and slightly frustrum-shaped faucet body upper portion 242 of the hollow faucet body 224, at the faucet body upper portion upper laterally-disposed throughbore 243 of the hollow, open-ended, and slightly frustrum-shaped faucet body upper portion 242 of the hollow faucet body 224.

The internally-disposed metering assembly 261 includes a hollow, open front, substantially closed top and bottom, and parallelepiped-shaped internally-disposed metering assembly enclosure 263 that has a substantially closed metering assembly enclosure top 265, a substantially closed metering assembly enclosure bottom 267, and an open metering assembly enclosure front 269.

The interior of the hollow, open front, substantially closed top and bottom, and parallelepiped-shaped internally-disposed metering assembly enclosure 263 of the internally-disposed metering assembly 261 is in direct fluid communication with the interior space of the hollow, open-ended, and cylindrically-shaped faucet body sprinkler housing 253 of the hollow faucet body 224, via the open metering assembly enclosure front 269 of the hollow, open front, substantially closed top and bottom, and parallelepiped-shaped internally-disposed metering assembly enclosure 263 of the internally-disposed metering assembly 261 being in fluid communication with the faucet body upper portion upper laterally-disposed throughbore 243 of the hollow, open-ended, and slightly frustrum-shaped faucet body upper portion 242 of the hollow faucet body 224.

A longitudinally-oriented, centrally-disposed, and internally-threaded metering assembly throughbore 270 passes in longitudinal alignment through the centers of both the substantially closed metering assembly enclosure top 265 of the hollow, internally-disposed, open front, substantially closed top and bottom, and parallelepiped-shaped metering assembly enclosure 263 of the internally-disposed metering assembly 261 and the substantially closed metering assembly enclosure bottom 267 of the hollow, internally-disposed, open front, substantially closed top and bottom, and parallelepiped-shaped metering assembly enclosure 263 of the internally-disposed metering assembly 261.

The interior space of the hollow, internally-disposed, open front, substantially closed top and bottom, and parallelepiped-shaped metering assembly enclosure 263 of the internally-disposed metering assembly 261 is in direct fluid communication with the interior space of the hollow, open-ended, and slightly frustrum-shaped faucet body upper portion 242 of the hollow faucet body 224, via the longitudinally-oriented, centrally-disposed, and internally-threaded metering assembly throughbore 270 of the hollow, internally-disposed, open front, substantially closed top and bottom, and parallelepiped-shaped metering assembly enclosure 263 of the internally-disposed metering assembly 261.

The internally-disposed metering assembly 261 further includes a longitudinally-oriented and externally-threaded metering assembly allen screw 272 that threadably mates with the longitudinally-oriented, centrally-disposed, and internally-threaded metering assembly throughbore 270 of the hollow, internally-disposed, open front, substantially closed top and bottom, and parallelepiped-shaped metering assembly enclosure 263 of the internally-disposed metering assembly 261, so that the amount of direct fluid communication between the interior space of the hollow, internally-disposed, open front, substantially closed top and bottom, and parallelepiped-shaped metering assembly enclosure 263 of the internally-disposed metering assembly 261 and the interior space of the hollow, open-ended, and slightly frustrum-shaped faucet body upper portion 242 of the hollow faucet body 224 can be readily adjusted.

The longitudinally-oriented and externally-threaded metering assembly allen screw 272 of the internally-disposed metering assembly 261 is a non-corrosive material, such as but not limited, to plastic or the like.

The longitudinally-oriented and externally-threaded metering assembly allen screw 272 of the internally-disposed metering assembly 261 is moved relative to the longitudinally-oriented, centrally-disposed, and internally-threaded metering assembly throughbore 270 of the hollow, internally-disposed, open front, substantially closed top and bottom, and parallelepiped-shaped metering assembly enclosure 263 of the internally-disposed metering assembly 261. by the standard allen key 74.

The operation of the second embodiment of the self-cleaning knob water faucet 210 can best be seen in FIG. 4 and 5, and as such, will be discussed with reference thereto.

Water from a water source enters the hollow, open-ended, externally-threaded, and cylindrically-shaped faucet body lower portion 226 of the hollow faucet body 224 in the direction of water source arrows 300.

When the self-cleaning knob water faucet 210 is in the open position, water enters the hollow, open-ended, and slightly frustrum-shaped faucet body upper portion 242 of the hollow faucet body 224, in the direction of body water arrows 301.

Once the water enters the hollow, open-ended, and slightly frustrum-shaped faucet body upper portion 242 of the hollow faucet body 224, it is divided into two parts.

A first and larger part of the water enters the hollow, open-ended, and inverted J-shaped overhead faucet body arm 240 of the hollow faucet body 224, in the direction of arm water arrows 303. The spout water 16 exits the spout 18 in the direction of spout water arrows 304.

The remaining and smaller part of the water enters and passes through the longitudinally-oriented, centrally-disposed, and internally-threaded metering assembly throughbore 270 of the hollow, internally-disposed, open front, substantially closed top and bottom, and parallelepiped-shaped metering assembly enclosure 263 of the internally-disposed metering assembly 261.

The water passing through the longitudinally-oriented, centrally-disposed, and internally-threaded metering assembly throughbore 270 of the hollow, internally-disposed, open front, substantially closed top and bottom, and parallelepiped-shaped metering assembly enclosure 263 of the internally-disposed metering assembly 261 enters and passes through the hollow, open-ended, and cylindrically-shaped faucet body sprinkler housing 253 of the hollow faucet body 224, in the direction of shower water arrow 306.

The water passing through the hollow, open-ended, and cylindrically-shaped faucet body sprinkler housing 253 of the hollow faucet body 224 becomes the showering water 14 and self-cleans the knob 15.

To adjust the amount of water entering the internally-disposed metering assembly 261 and ultimately the amount of water that is going to clean the knob 15, the hollow and open-ended packing lock fitting 250 is loosened and the hollow, open-ended, and inverted J-shaped overhead faucet body arm 240 of the hollow faucet body 224 is removed from the hollow faucet body 224.

The allen key 74 is used to position the longitudinally-oriented and externally-threaded metering assembly allen screw 272 of the internally-disposed metering assembly 261 in the longitudinally-oriented, centrally-disposed, and internally-threaded metering assembly throughbore 270 of the hollow, internally-disposed, open front, substantially closed top and bottom, and parallelepiped-shaped metering assembly enclosure 263 of the internally-disposed metering assembly 261.

It will be understood that each of the elements described above, or two or more together, may also find a useful application in other types of constructions differing from the types described above.

While the invention has been illustrated and described as embodied in a self-cleaning knob water faucet, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-cleaning knob water faucet, comprising:

a) a hollow water faucet body having an interior space and a spout from which water can exit;

b) a water valve assembly disposed in said hollow water faucet housing and having a distal end extending outwardly therefrom, said water valve further having a closed position in which water does not exit said spout of said hollow water faucet body and an open position in which water exits said spout of said hollow water faucet body;

c) a knob disposed on said distal end of said water valve and rotatable by a hand of user for moving said water valve assembly through said closed position of said water valve assembly and said open position of said water valve assembly; and d) water showering means for showering water on said knob when said water valve assembly is in said open position of said water valve assembly, so that any contamination deposited on said knob when said knob is rotated by the hand of the user is removed, wherein said water valve assembly includes said water showering means, wherein said water valve assembly further includes a hollow, longitudinally-oriented, externally-threaded, cylindrically-shaped, and slender valve stem that has a longitudinal axis, a proximal end disposed in said hollow water faucet body, a distal end disposed outside said hollow water faucet body, and an internally-disposed and longitudinally-oriented channel that extends from said proximal end of said hollow, longitudinally-oriented, externally-threaded, cylindrically-shaped, and slender valve stem of said water valve assembly to said distal end of said hollow, longitudinally-oriented, externally-threaded, cylindrically-shaped, and slender valve stem of said water valve assembly, wherein said proximal end of said hollow, longitudinally-oriented, externally-threaded, cylindrically-shaped, and slender valve stem of said water valve assembly has a laterally-oriented and internally-threaded metering throughbore that passes completely through said proximal end of said hollow, longitudinally-oriented, externally-threaded, cylindrically-shaped, and slender valve stem of said water valve assembly; said laterally-oriented and internally-threaded metering throughbore of said proximal end of said hollow, longitudinally-oriented, externally-threaded, cylindrically-shaped, and slender valve stem of said water valve assembly opens into both said internally-disposed and longitudinally-oriented channel of said hollow, longitudinally-oriented, externally-threaded, cylindrically-shaped, and slender valve stem of said water valve assembly and said interior space of said hollow faucet body, so that there is an amount of direct fluid communication between said internally-disposed and longitudinally-oriented channel of said hollow, longitudinally-oriented, externally-threaded, cylindrically-shaped, and slender valve stem of said water valve assembly and said interior space of said hollow faucet body.

2. The faucet as defined in claim 1, wherein said proximal end of said hollow, longitudinally-oriented, externally-threaded, cylindrically-shaped, and slender valve stem of said water valve assembly further has a laterally-oriented and externally-threaded metering screw that threadably engages said laterally-oriented and internally-threaded metering throughbore of said proximal end of said hollow, longitudinally-oriented, externally-threaded, cylindrically-shaped, and slender valve stem of said water valve assembly, so that said amount of direct fluid communication between said internally-disposed and longitudinally-oriented channel of said hollow, longitudinally-oriented, externally-threaded, cylindrically-shaped, and slender valve stem of said water valve assembly and said interior space of said hollow faucet body can be metered.

3. The faucet as defined in claim 2, wherein said laterally-oriented and externally-threaded metering screw of said proximal end of said hollow, longitudinally-oriented, externally-threaded, cylindrically-shaped, and slender valve stem of said water valve assembly is plastic.

4. The faucet as defined in claim 2, further comprising an allen key that is removably engagable with said laterally-oriented and externally-threaded metering screw of said proximal end of said hollow, longitudinally-oriented, externally-threaded, cylindrically-shaped, and slender valve stem of said water valve assembly, so that said laterally-oriented and externally-threaded metering screw of said proximal end of said hollow, longitudinally-oriented, externally-threaded, cylindrically-shaped, and slender valve stem of said water valve assembly can be readily moved relative to said laterally-oriented and internally-threaded metering throughbore of said proximal end of said hollow, longitudinally-oriented, externally-threaded, cylindrically-shaped, and slender valve stem of said water valve assembly.

5. The faucet as defined in claim 1, wherein said knob has an upper surface with a longitudinally-oriented, centrally-disposed, and cylindrically-shaped upper chamber that has a longitudinal axis and a diameter; said longitudinally-oriented, centrally-disposed, and cylindrically-shaped upper chamber of said upper surface of said knob opens into said upper surface of said knob; said longitudinal axis of said longitudinally-oriented, centrally-disposed, and cylindrically-shaped upper chamber of said upper surface of said knob is collinear with said longitudinal axis of said hollow, longitudinally-oriented, externally-threaded, cylindrically-shaped, and slender valve stem of said water valve assembly.

6. The faucet as defined in claim 5, wherein said knob further has a lower surface with a longitudinally-oriented and centrally-disposed lower chamber that has a longitudinal axis and a diameter; said longitudinally-oriented and centrally-disposed lower chamber of said lower surface of said knob opens into said lower surface of said knob; said longitudinal axis of said longitudinally-oriented and centrally-disposed lower chamber of said lower surface of said knob is collinear with said longitudinal axis of said hollow, longitudinally-oriented, externally-threaded, cylindrically-shaped, and slender valve stem of said water valve assembly; said longitudinally-oriented and centrally-disposed lower chamber of said lower surface of said knob securely receives said distal end of said hollow, longitudinally-oriented, externally-threaded, cylindrically-shaped, and slender valve stem of said water valve assembly, so that rotation of said knob relative to said water valve assembly is eliminated.

7. The faucet as defined in claim 6, wherein said knob further has a longitudinally-oriented, centrally-disposed, and cylindrically-shaped intermediate chamber that has a longitudinal axis and a diameter; said longitudinally-oriented, centrally-disposed, and cylindrically-shaped intermediate chamber of said knob opens into both said longitudinally-oriented, centrally-disposed, and cylindrically-shaped upper chamber of said upper surface of said knob and said longitudinally-oriented and centrally-disposed lower chamber of said lower surface of said knob; said longitudinal axis of said longitudinally-oriented, centrally-disposed, and cylindrically-shaped intermediate chamber of said knob is collinear with said longitudinal axis of said hollow, longitudinally-oriented, externally-threaded, cylindrically-shaped, and slender valve stem of said water valve assembly; said diameter of said longitudinally-oriented, centrally-disposed, and cylindrically-shaped intermediate chamber of said knob is less than said diameter of each of said longitudinally-oriented, centrally-disposed, and cylindrically-shaped upper chamber of said upper surface of said knob and said longitudinally-oriented and centrally-disposed lower chamber of said lower surface of said knob, so that said distal end of said hollow, longitudinally-oriented, externally-threaded, cylindrically-shaped, and slender valve stem of said water valve assembly will not pass through said knob.

8. The faucet as defined in claim 7, further comprising a hollow knob mounting bolt for readily removably securing said knob to said distal end of said hollow, longitudinally-oriented, externally-threaded, cylindrically-shaped, and slender valve stem of said water valve assembly.

9. The faucet as defined in claim 8, wherein said hollow knob mounting bolt has a hollow, open-ended, and octagon-shaped upper portion with a diameter and, an interior space, so that said hollow knob mounting bolt can be readily turned by a conventional tool; said diameter of said hollow, open-ended, and octagon-shaped upper portion of said hollow knob mounting bolt is greater than said diameter of said longitudinally-oriented, centrally-disposed, and cylindrically-shaped intermediate chamber of said knob, so that said hollow knob mounting bolt will not pass therethrough.

10. The faucet as defined in claim 9, wherein said hollow, open-ended, and octagon-shaped upper portion of said hollow knob mounting bolt has a plurality of radially-disposed channels that open into both said interior space of said hollow, open-ended, and octagon-shaped upper portion of said hollow knob mounting bolt and said longitudinally-oriented, centrally-disposed, and cylindrically-shaped upper chamber of said upper surface of said knob.

11. The faucet as defined in claim 10, wherein said hollow knob mounting bolt further has a hollow, open-ended, externally-threaded, and cylindrically-shaped lower portion with an interior space; said hollow, open-ended, externally-threaded, and cylindrically-shaped lower portion of said hollow mounting bolt is integral with, and extends downwardly from, said hollow, open-ended, and octagon-shaped upper portion of said knob mounting bolt; said interior space of said hollow, open-ended, externally-threaded, and cylindrically-shaped lower portion of said hollow knob mounting bolt opens into both said interior space of said hollow, open-ended, and octagon-shaped upper portion of said hollow knob mounting bolt and said internally-disposed and longitudinally-oriented channel of said hollow, longitudinally-oriented, externally-threaded, cylindrically-shaped, and slender valve stem of said water valve assembly.

12. The faucet as defined in claim 11, wherein said hollow, open-ended, externally-threaded, and cylindrically-shaped lower portion of said hollow mounting bolt passes through said longitudinally-oriented, centrally-disposed, and cylindrically-shaped intermediate chamber of said knob and threadably engages said hollow and internally-threaded distal end of said hollow, longitudinally-oriented, externally-threaded, cylindrically-shaped, and slender valve stem of said water valve assembly, so that said knob can be readily removably secured to said hollow, longitudinally-oriented, externally-threaded, cylindrically-shaped, and slender valve stem of said water valve assembly.

13. The faucet as defined in claim 10, further comprising a convexo-concave-shaped decorative button that is removably snapingly mounted in said longitudinally-oriented, centrally-disposed, and cylindrically-shaped upper chamber of said upper surface of said knob and has a plurality of radially-disposed channels; said plurality of radially-disposed channels of said convexo-concave-shaped decorative button open into both the ambient and said longitudinally-oriented, centrally-disposed, and cylindrically-shaped upper chamber of said upper surface said knob, so that water passing through the said plurality of radially-disposed channels of said convexo-concave-shaped decorative button shower and clean said knob.

14. The faucet as defined in claim 1, wherein said water showing means is disposed at said hollow water faucet body above said water valve assembly.

15. The faucet as defined in claim 14, wherein said water showering means includes a hollow, open-ended, and cylindrically-shaped sprinkler housing that has an interior space that opens into both said interior space of said hollow water faucet body and the ambient; said hollow, open-ended, and cylindrically-shaped sprinkler housing of said water showering means is oriented outwardly and downwardly towards said knob.

16. The faucet as defined in claim 15, wherein said water showering means further includes a hollow, open front, substantially closed top and bottom, and internally-disposed enclosure that has a substantially closed top, a substantially closed bottom, an open front, and is disposed internally to said hollow water faucet body; said hollow, open front, substantially closed top and bottom, and internally-disposed enclosure of said water showering means opens into said hollow, open-ended, and cylindrically-shaped sprinkler housing through said open front of said hollow, open front, substantially closed top and bottom, and internally-disposed enclosure of said water showering means; said hollow, open front, substantially closed top and bottom, and internally-disposed enclosure of said water showering means further has a longitudinally-oriented and internally-threaded throughbore that passes in longitudinal alignment completely through both said substantially closed top of said hollow, open front, substantially closed top and bottom, and internally-disposed enclosure of said water showering means and said substantially closed bottom of said hollow, open front, substantially closed top and bottom, and internally-disposed enclosure of said water showering means.

17. The faucet as defined in claim 16, wherein said water showering means further includes a longitudinally-oriented and externally-threaded screw that threadably engages said longitudinally-oriented and internally-threaded throughbore of said hollow, open front, substantially closed top and bottom, and internally-disposed enclosure of said water showering means.

* * * * *